United States Patent [19]

Sanborn et al.

[11] Patent Number: 4,571,983

[45] Date of Patent: Feb. 25, 1986

[54] REFRACTORY METAL COATED METAL-WORKING DIES

[75] Inventors: Harold C. Sanborn, Bolton; Frank Carago, South Windsor; John R. Kreeger, Hebron, all of Conn.

[73] Assignee: United Technologies Corporation, Hartford, Conn.

[21] Appl. No.: 728,958

[22] Filed: Apr. 30, 1985

[51] Int. Cl.[4] ..... B05D 1/08; B21K 5/20

[52] U.S. Cl. ..... 72/462; 29/402.18; 72/467; 72/476; 76/107 R; 76/DIG. 6; 76/DIG. 11; 427/34; 427/142; 427/423

[58] Field of Search ..... 427/34, 423, 140, 142; 29/402.18; 76/107 R, 107 A, DIG. 2, DIG. 6, DIG. 11; 72/467, 462, 476

[56] References Cited

U.S. PATENT DOCUMENTS

| | | | |
|---|---|---|---|
| 1,551,333 | 8/1925 | Schroter et al. | 76/DIG. 11 |
| 1,742,417 | 1/1930 | Schrobsdorff | 76/DIG. 11 |
| 2,392,821 | 1/1946 | Kreag | 72/476 |
| 2,494,970 | 1/1950 | Shea | 29/402.18 |
| 3,230,759 | 1/1966 | Schoenfeld et al. | 72/467 |
| 3,791,799 | 2/1974 | Heitzinger | 72/467 |
| 4,095,449 | 6/1978 | Roach et al. | 72/467 |
| 4,175,611 | 11/1979 | Fletcher | 427/34 |

FOREIGN PATENT DOCUMENTS

| | | | |
|---|---|---|---|
| 9365 | 1/1981 | Japan | 72/476 |

*Primary Examiner*—John H. Newsome
*Attorney, Agent, or Firm*—Charles E. Sohl

[57] ABSTRACT

Metal-working dies which are typically made of steel are provided with substantially enhanced life by receiving a plasma-sprayed refractory metal coating which is subsequently compacted under conditions of minimum shear stress. The number of working cycles which can be obtained from a die before it is necessary to rework the die can be improved by as much as 3500%.

4 Claims, No Drawings

REFRACTORY METAL COATED METAL-WORKING DIES

DESCRIPTION

Technical Field

This invention pertains to the surface treatment of metal-working dies for improved life.

Background Art

Metal-working dies are widely used in modern industry. Such dies typically are used to work or fabricate metal in compression under high loads. A wide variety of metals can be used for such dies, steel being the most widely used material. Working of metal using dies can be performed at room temperatures or elevated temperatures up to perhaps 1500° F. in the case of steel dies. The life of metal-working dies is typically dictated by surface wear. Surface wear can occur by friction wherein the metal being worked abrades the surface of the die or it can occur by galling. In galling, localized welding occurs between the metal being worked and the die surface and when the finished part is removed from the die some small portion of the die is removed with the finished part or, a portion of the finished part may be left adhered to the die surface. This process continues until the surface condition of the die is unsuited for further use. Lubricants are commonly applied to metal-working dies and/or the metal being worked in an effort to reduce friction and galling. This is only partly successful, however, the high loads applied in the metal-working process which can be on the order of tons per square inch can quickly break through lubricating films especially at localized high stress regions between the die and the workpiece. Attempts have been made to increase the surface life of metal-working dies by applying hard finishes, for example, hard chrome plate. Such expedients are reasonably successful at lower temperatures. Other types of hardening surface treatments such as carborizing, nitriding and ion implantation have also been attempted with varying degrees of success, largely dependent upon operating conditions. Many of these surface-hardening treatments are somewhat deleterious in the long run in that they can interfere with subsequent reworking of the dies which will be necessary as a result of surface wear.

Molybdenum is an element which finds widespread application in the fabrication of automotive piston rings. Such piston rings fit in grooves in the piston and are resiliently urged against the cylinder walls and act to seal the operating cylinder volume from the ambient atmosphere. The piston rings slide at relatively high rates within the cylinder. Because of the need to minimize friction, the normal force between the piston ring and the cylinder wall is kept to a minimum. U.S. Pat. No. 3,901,131 describes a molybdenum-filled, U-shaped cross section piston ring. U.S. Pat. Nos. 4,233,072 and 4,420,543 both deal with piston rings having flame or plasma-sprayed surfaces consisting of molybdenum along with lesser amounts of other ingredients such as tungsten carbide and ferrochrome.

U.S. Pat. No. 3,874,165 describes a metalworking device for shaping horseshoes. At one point in column 4, reference is made to the use of a dry powdered molybdenum lubricant on various bearing surfaces within the machine, although it does not appear that a molybdenum lubricant is used between the forming dies and the horseshoe itself. Further, it should be noted and appreciated that the art is somewhat sloppy in its treatment of the term molybdenum. It appears that molybdenum disulfide compound which is widely used as a lubricant is often misdescribed as being molybdenum. U.S. Pat. No. 4,097,257 describes a surface treatment for molds used to form glass articles. The surface treatment comprises a complex mixture of compounds and includes what is termed molybdenum and/or graphite dispersed in a hardened binder. This is described as being highly effective in improving surface quality in the finished article. U.S. Pat. No. 4,022,265 deals with a continuous casting apparatus having mold components which slide relative to each other and the suggestion is made that a molybdenum lubricant be used. This appears to be a commercially available molybdenum disulfide base material. U.S. Pat. No. 4,202,657 describes a rotary pump apparatus and in column 3 describes a component that may be made of a self-lubricating material which may include teflon, molybdenum, graphite, etc.

It should be noted that all of these patent disclosures deal with applications in which relatively low forces are exerted between the respective surfaces which are separated by the lubricant film. Correspondingly, a substantial amount of relative motion generally occurs between these surfaces. The overall lubricant purpose is to reduce friction. In the case of metal-working dies, a converse situation is observed in that the force between the surfaces which are separated by the lubricating film are extremely high, and relative motion between these surfaces is generally small.

Disclosure of Invention

The present invention is directed to a method for improving the surface life of metal-working dies and to dies whose surfaces having been so treated. Such dies have predetermined contours and are used to form metal to the mirror image contour. The surface treatment consists of plasma spraying a (in this application the phrase "plasma spraying" is meant to include similar processes including flame spraying) thin layer of a refractory metal selected from the group consisting of molybdenum, columbium, tantalum, tungsten, rhenium and hafnium onto the surface of the die which contacts the workpiece and then consolidating the plasma-sprayed layer by processing through the die a workpiece which has previously been formed to the desired end shape. By using a workpiece which has previously been formed to the desired shape, metal flow and shear stresses are reduced to a minimum and the effective forces acting on the die surface are almost entirely normal forces which serve to compact the plasma-sprayed layer without causing it to shear or spall.

The foregoing, and other features and advantages of the present invention, will become more apparent from the following description.

Best Mode for Carrying Out the Invention

The invention has been applied to steel dies made of various steels such as H13 type tool steel (nominal composition 0.35% C, 5% Cr, 1% V, 1.5% Mo, balance essentially Fe), heat treated according to commercial practice as set forth in the *Metals Handbook*, Vol. 2, page 234, 1975, etc. It will be observed, however, that the treatment might be applied to a wide variety of other steels and indeed to other die materials including, for example, nickel alloys. The material is applied to the surface of the dies by plasma spraying, using conventional techniques, for example, a Metco plasma gun may be operated at 40 volts, 700 amps, 1.2 cubic feet per minute of helium carrier gas and 22 grams per minute of refractory metal to apply the coating to the die surface. The coating is applied to a thickness which need be only from 2 to 5 mils but may be greater for reasons to be described below.

The material to be deposited is a refractory metal and may be selected from the group consisting of molybdenum, columbium, tantalum, tungsten, rhenium, hafnium and generally to alloys which contain more than about 80% of these elements alone or in combination. It is hypothesized that the beneficial effects due to the refractory metal coating are largely the result of the surface oxide which forms on these elements and which has a generally lubricating nature. For this reason it is anticipated that any alloy containing more than about 80% of these materials would be satisfactory since it would be anticipated that the surface oxide formed on such an alloy would be basically that of the refractory metal. It is, of course, possible to conceive of a nonuseful alloy which might for example contain aluminum and thereby form an abrasive aluminum oxide layer which will not be suitable. However, it is believed that such alloys would not be common and that anyone skilled in the art will be readily able to evaluate the suitability of a given alloy for the purpose either by trial and error or through available laboratory techniques for surface oxide analysis.

In particular, the four metals, molybdenum, columbium, tantalum and tungsten all form continuous solid solutions with other metals within the group. Thus, it appears that any mixture comprised of these four metals would be entirely satisfactory for the application of coating metal-working dies. As a practical matter, we greatly prefer the use of molybdenum since it is the most economical of these metals and is readily available in powdered form suitable for plasma spraying.

The metals, molybdenum, tungsten, columbium, tantalum, rhenium and hafnium are all hard metals having melting points in excess of about 4000° F. and suitable ductility so that in plasma-sprayed form they resist cracking under the deformation which they undergo in the metal-working process. The high melting point is an indicator that surface welding between the die coating and the workpiece is unlikely. High hardness also indicates that the amount of metal flow in the surface coating will be minimal and that galling will probably not occur. In addition, these elements all have a high energy of formation for oxides, indicating that under almost any conceivable operating conditions of temperature or atmosphere, a stable oxide layer will form and this is the case even in reducing inert or vacuum atmospheres. It is again speculated that this oxide layer is further responsible for the lack of surface deterioration which is observed when the invention process is performed.

Following the plasma deposition of a layer of the refractory metal, the deposited layer is compacted or coined by processing through the dies an article of the metal to be formed (or similar material) which has previously been formed to the desired final shape either in the dies being treated (prior to treatment) or in other dies of the same geometry. When such a finished part is processed between the dies under production conditions of temperature and pressure, it is observed that the plasma-sprayed layer which as sprayed has a dull appearance is transformed into a layer having a shiny appearance apparently by compaction and minor deformation of the plasma-sprayed material. As previously indicated, by using a part having the final configuration, there will be minimal metal flow in the workpiece and hence minimal shear stress on the die coating which will assist in maintaining the surface integrity of the coating during this initial compaction operation.

Following the compaction step, the dies may be used in their normal production operation, using the lubricants which would be normally found to be desirable for uncoated dies.

In one application in which H13 heat treated steel dies were used to form titanium with a glass lubricant, the application of a 2–5 mil plasma-sprayed layer of molybdenum followed by surface compaction as previously described, was found to increase the die life (the life between surface repairs) from 200 parts produced to over 2000 parts produced with no evidence of die surface wear or dimensional change. This degree of life improvement is completely unexpected and highly beneficial. The economic significance of this improvement can be appreciated from the fact that whereas several hundred man hours are required to produce an original die and several tens of man hours are required to rework a worn die; the plasma-spray process of the present invention requires less than one man hour to apply and has negligible material cost but provides several thousands of percentage improvement in die life.

In another application, a steel die used to extrude a nickel base alloy had a coating of molybdenum applied to is throat area. As a first step in the process, the bare steel die was used to partially extrude the nickel base alloy in question (using a conventional glass-graphite lubricant). The partially extruded material was removed and was in the form of a piece of material whose contour matched the extrusion die throat contour. The extrusion die was then given a nominal 3 mil plasma spray of molybdenum. The partial extrusion was then reinserted in the die and the extrusion process was continued using the same lubricant. A slow extrusion rate was initially employed to compact and densify the plasma-sprayed coating prior to any high velocity material flow. Subsequently, it was found that more than 600 extrusions could be produced before it was necessary to rework the extrusion die. In the absence of the molybdenum coating, only about 10 extrusions could be produced before it was necessary to rework the extrusion die.

The primary benefit of the present invention is increased die life. However, it was also observed that parts produced using invention coated dies are more dimensionally accurate than parts produced using uncoated dies. Whereas, in using uncoated dies a certain amount of trial and error die rework is necessary to produce a precision part, using the coated dies of the present invention results in parts having the desired shape without the need to change die contours. A certain amount of this is attributable to the improved uniformity of lubrication afforded by the somewhat porous compacted plasma spray coating.

Another benefit of the present invention is that the molybdenum layer while hard and durable can be machined using conventional tools used by tool and die makers in the finishing and repair of steel dies. Thus, for example, whereas die coating materials which were tried of extremely hard materials such as for example tungsten carbide, could not be repaired by tool and die makers without total removal of the coating, the refractory metal coatings of the present invention could be machined and shaped with no more difficulty than that encountered in machining and shaping steel die material. This leads to the suggestion that the present invention can be used to repair dies which have been substantially worn without the necessity to completely remake the die. Thus, for example in dies, certain portions of the dies are observed to wear at much greater rates than other portions. In such a case a substantially thicker layer of molybdenum can be applied locally to a worn area and then machined to the desired configuration as a repair technique. The repair technique will also increase the life of the locally treated die region.

Although the invention has been shown and described with respect to detailed embodiments thereof, it will be understood by those skilled in the art that various changes in form and detail thereof may be made without departing from the spirit and scope of the claimed invention.

We claim:

1. A method for improving the durability of metal-working dies having surfaces with predetermined contours including the steps of:

a. working at least one article to said predetermined contours using said dies;

b. plasma spraying at least a portion of the contoured surfaces with a material selected from the group consisting of molybdenum, columbium, tantalum, tungsten, rhenium, hafnium, and mixtures thereof;

c. reforming the article shaped in step a. in said coated dies to densify said sprayed coating without causing substantial metal flow or shear stresses;

whereby the coated, densified dies exhibit substantially enhanced resistance to wear during use.

2. A method as in claim 1 wherein said coating consists essentially of molybdenum.

3. A metal-working die having on its surface a compacted plasma sprayed coating of a material selected from the group consisting of molybdenum, columbium, tantalum, tungsten, rhenium, hafnium, and mixtures thereof.

4. A metal working die as in claim 3 in which said coating material is essentially molybdenum.

* * * * *